US006311859B1

(12) United States Patent
Haas

(10) Patent No.: US 6,311,859 B1
(45) Date of Patent: Nov. 6, 2001

(54) PAIRED RECYCLING AND REFUSE CONTAINERS

(76) Inventor: Philip C. Haas, R.D. #2, Box 159, Kempton, PA (US) 18529

( * ) Notice: Subject to any disclaimer, the term of this patent is extended or adjusted under 35 U.S.C. 154(b) by 0 days.

(21) Appl. No.: 09/519,252

(22) Filed: Mar. 6, 2000

(51) Int. Cl.[7] ..... B65D 90/04
(52) U.S. Cl. ..... 220/4.22; 220/628; 220/908
(58) Field of Search ..... 220/4.22, 4.23, 220/4.24, 495.06, 495.01, 628, 908, 909

(56) References Cited

U.S. PATENT DOCUMENTS

D. 258,409 * 3/1981 Nattrass ..... 220/908
1,157,008 * 10/1915 Lang ..... 220/908
3,063,591 * 11/1962 Laginestra ..... 220/908
4,923,080 * 5/1990 Lounsbury ..... 220/908
4,955,497 * 9/1990 Winden et al. ..... 220/408
5,540,351 * 7/1996 Leuscher ..... 220/407

* cited by examiner

*Primary Examiner*—Joseph M. Moy
(74) *Attorney, Agent, or Firm*—Charles A. Wilkinson

(57) ABSTRACT

A refuse and recycling receptacle assembly is constructed of two half round slatted receptacles hingedly secured to an intermediate stand upon which plastic garbage bags and the like can be attached. When it is wished to empty the plastic containers, the slatted receptacles can be pivoted out of the way allowing convenient access to the actual containers, which are protected at other times by the slatted half round receptacles which serve as covers for the actual trash receiving containers.

6 Claims, 4 Drawing Sheets

PAIRED RECYCLING AND REFUSE CONTAINERS

BACKGROUND OF THE INVENTION (1) Field of the Invention

This invention relates broadly to the collection of recyclables and more particularly to the provision of high volume yet elegant appearing containers that are paired together to form a single free-standing unit, convertible, if desired, to single units for mounting against another surface.

(2) Description of the Prior Art

During the last two or three decades the public collection of recyclables such as cans of various compositions, glass bottles, plastics, paper products and other nominal waste materials and particularly waste packaging materials which can be recycled has come more and more to the fore. Public bodies such as municipalities, state and federal parks and other public bodies as well as corporate entities such as large companies and the like have undertaken to provide recycling and refuse receivers in public places to encourage the public to both dispose of their refuse and to aid in the collection of recyclables for further processing.

At one time, the common public container for all kinds of waste materials was the ubiquitous heavy wire-mesh container. Such containers were fairly durable due to their heavy construction plus a certain degree of resiliency or bendability conferred by the open mesh wire construction. Such containers, however, have the disadvantage that the contents are exposed to public view and are frequently objectionable to many members of the public. In more recent years, various solid containers such as, in many cases, concrete containers and the like have been substituted for the former wire-mesh containers, although wire-mesh containers are still used, particularly where aesthetics is not a factor. While such concrete and the like containers are fairly durable and in many cases, particularly when they have an exterior surface of small decorative stones or the like, not unattractive, they are in many cases both difficult to empty and also expensive. Generally, solid containers made of thin coated metal or even durable plastic, including heavy plastic materials, are fairly economical and easy to handle, but objectionable to many people simply because they look like "garbage cans." They are also often subject to vandalism, since they can be easily picked up, knocked over and otherwise mishandled, in which case the metal tends to bend and flake off its coating, after which it becomes subject to corrosion. Plastic containers, in addition, can usually be fairly easily cracked or otherwise damaged when attacked by a determined vandal.

Within the last twenty years, a type of container having a decorative exterior composed originally of wood slats to give it a rustic appearance and more recently of plastic slats which look like wood or similar materials have come into use, particularly in upscale locations such as in shopping centers, public parks, the interior of large buildings and other places where it is desired to have a trash or recycling receptacle in plain sight, but the appearance of an ordinary trash receptacle or garbage may be unacceptable. The provision of vertical wooden slats or artificial material slats having the appearance of wood over a cylindrical receptacle is particularly desirable because of the rustic appearance provided plus the ease of applying a vertical slat to the exterior of a cylindrical container, so long as the slat is maintained longitudinally aligned with the length of the cylinder. As indicated above, such receptacles have been in use for about two and a half decades and have been extremely popular for about a decade and a half. Such receptacles have been made in various ways including the attachment of the rustic slats on the outside of an ordinary trash can or barrel as well as the provision of a cylindrically shaped receptacle by the use of various internal supporting means such as structural rings and the like to reinforce the other slats so that the combination of the slats and the rings forms their own receptacle. If adequately reinforced internally, such slatted exterior ring-reinforced type containers have proved reasonably strong and durable.

Within the last several years a new type of container or receptacle having a slatted exterior has come into use. This By type of container or receptacle is provided with a slanted top rather than a flat top, resulting in a particularly attractive design. Furthermore, when such slatted receptacles are arranged around a central unifying post, a particularly attractive and aesthetically pleasing arrangement is provided. Such an arrangement is disclosed in U.S. Design Patent 331,824 issued Dec. 15, 1992. The initial construction of the new slanted top slatted receptacles was effected by fastening slats with threaded fasteners to the exterior of an ordinary steel barrel with the fastening passing into the external barrel hoops on such barrel. The internal steel barrel formed a strong construction for the container itself and the slatted exterior with attached differential length slats provided a pleasing appearance to the exterior. When a lid was desired, a flat lid was merely placed in the top supported by internal tabs spaced, usually at four locations, on the interior of the slats. The top could either be supported in a horizontal position or preferably was slanted to conform more or less with the top of the receptacle. Unfortunately, while the described arrangement provided a strong lower section to the receptacle, the upper slanted portion was left essentially unsupported, particularly with respect to the longer or higher slats and there was, furthermore, no satisfactory way to securely attach the top to the receptacle.

An oval reinforcing or structural ring was developed to reinforce the upper portion of these slanted top slatted receptacles and more recently flat topped slatted receptacles have come into use. Particularly where these are provided with the present inventor's method for bowing the slats of the receptacles either inwardly or outwardly to a slight degree to provide a more pleasing outline, these flat topped receptacles have met with much favor in the market. The tops of these receptacles can be locked and are quite secure against vandals and the like.

One difficulty with a receptacle in which the top must be removed to remove the trash and recyclables collected therein is that in larger sizes of receptacles it is difficult to remove such materials, usually collected within the receptacle in plastic bags or separate thinner plastic containers, through the top of the plastic slatted container even with the entire top or lid removed. The larger the receptacle, or, more especially, the higher the receptacle, the more difficult such removal becomes. Yet it is frequently desirable to make such slatted receptacles higher rather than wider to increase the capacity, since in this way the receptacles take up less floor space. One solution to the removal of the contents of receptacles from the top is to remove such contents from the sides through a door or opening in the side. However, this has not proved to be a really satisfactory solution, because the provision of a side door in a slatted structure is difficult and expensive to implement and the person removing the contents is still forced to work from a cramped position and there then tends in addition to be wasted space in the upper portion of the receptacle.

There has been a need, therefore, to provide a recycling and refuse container from which collections of waste and recyclables can be removed easily and efficiently while still providing an attractive, strong, and damage resistant receptacle assembly. The present invention provides such an improved receptacle by providing in a principal embodiment a pair of adjacent half oval (which includes the usual half round) slatted receptacles movably mounted upon a support or stand in face to face position. Each receptacle has an open side where the two receptacles abut each other or the stand upon which stand or support plastic trash bags or the like can be hung or supported. When access is desired to the plastic containers, the slatted receptacles are pivoted from over such containers which can easily thereupon be accessed and removed for disposal.

OBJECTS OF THE INVENTION

It is an object of the present invention, therefore, to provide a plastic slatted receptacle assembly having a pleasing appearance.

It is a further object of the invention to provide a plastic slatted receptacle assembly in which the receptacles have open backs facing each other, which enables such receptacles to be swung away from each other to expose trash and receptacle containers within. The receptacles are preferably supported from a rack or stand and can be conveniently removed from such stand without unusual exertion and/or contortions.

It is a still further object of the invention to provide for hingedly supporting the plastic slatted receptacles upon a central support stand to allow swinging of such receptacles out of the way to gain access to the contents thereof.

It is a still further object of the invention to provide attractive alternative ways for removing the slatted containers or receptacles from over the plastic collection containers within.

It is a still further object of the invention to provide a support for plastic slatted receptacles that can be converted to support against or support from a structural wall of a building.

Other objects and advantages of the present invention will be recognized from reference to the following description and appended drawings.

BRIEF DESCRIPTION OF THE INVENTION

The invention provides a recycling and refuse receptacle assembly incorporating a pair of half oval (including the most frequent half round configuration) plastic slatted recycling and refuse receptacles with the usual construction of structural rings upon which are secured the plastic slats on the curved sections. The half oval slatted receptacles are hingedly supported upon a central frame that enables one or both slatted receptacles to be swung away from the framework to access light plastic or other containers supported upon the central frame from which said plastic containers can be easily removed for emptying or disposal. The complete opening or removal of the slatted receptacles enables refuse or recyclables collected within to be easily removed without significant stress or repetitive bending by the workman and the assembly is clean cut and pleasing in appearance.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
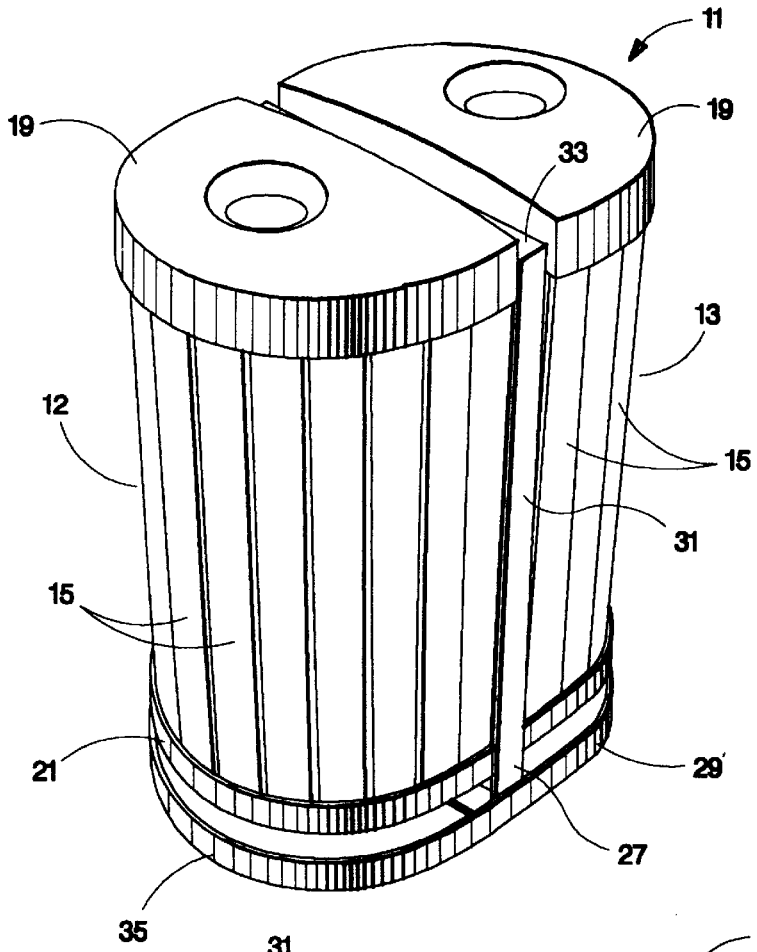
FIG. 1 is an isometric view of an assembly of the invention, showing two slatted receptacles mounted upon a base.
Figure 8:
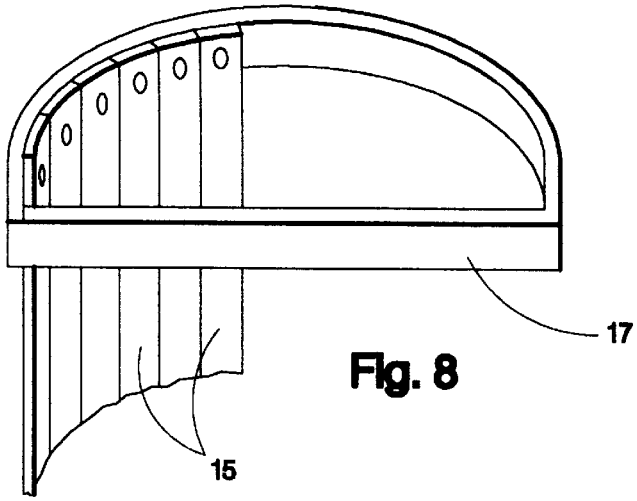
FIG. 8 is a partially broken away depiction of the top one of the receptacles showing one of the half-round structural rings that support the plastic slats.
Figure 9:
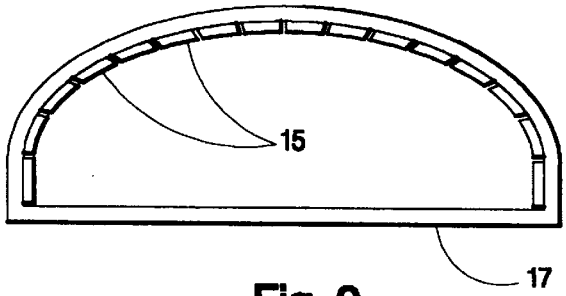
FIG. 9 is a top view of one of the half-oval receptacles with the top removed, showing one of the structural rings supporting the slats and illustrating how there are no slats attached to the straight section of the ring along the back.

FIG. 1 is a perspective view of the plastic slatted receptacle assembly of the invention in which there is shown a receptacle assembly 11 comprised of plastic slatted receptacles 12 and 13 each formed of plastic slats 15 secured to internal structural rings 17 (see FIGS. 8.and 9). Each of such structural rings 17 has a half-oval configuration as shown in FIGS. 8 and 9. At the top of each of the plastic slatted receptacles is a top 20 which may itself either be of plastic, in which case it will probably be used with the internal structural rings 17 or, if formed of sturdier metal, may itself serve as a structural attachment for the plastic slats 15. In the center of the top there will usually be a single restricted diameter orifice 20 through which refuse and/or recyclables such as plastic and aluminum containers and the like may be inserted. Several orifices may at times be appropriate.

At the bottom of the plastic slatted receptacles there is a bottom section 21 which conventionally is formed in the center with a grill pattern 23. Such grill 23 allows air access to the inside of the receptacle, but prevents small animals or the like from gaining entrance. The grill can best be seen in FIGS. 6 and 10.

A stand, or support, 25 is provided in the center of the receptacle assembly. Such stand is formed of a preferably rectangular upstanding support member 27 and a bottom stabilizing base portion 29 which spreads outwardly and maintains the upstanding member 27 in an attitude to support internal plastic or other containers as well as the two plastic slatted receptacles 12 and 13. As shown the upstanding rectangular support portion is formed of two side structural sections 31 plus a crosspiece 33. These support members can be formed of any suitably strong members such as angles, channels, small I-beams and/or the like and are shown formed of channel members welded together.

A base 29 to support the upstanding support member 27 is formed preferably of curved members 35 welded to the sides of the side sections 31 of the upstanding support member 27 so such member is held upright. Again, the curved members 35 can be made of any suitable material, but in view of their preferred curvature may be conveniently formed of a single strip of metal bent into the same general oval (or half-round) shape and welded to the lower portions of the side sections 31 of the upstanding support. This forms a conveniently vertically rigid member which can be fairly wide because of its position directly below the half-oval slatted receptacles, since it is removed thereby from a position where someone might trip over it. If desired, a rectangular base could be formed from straight structural sections welded together. Another alternative would be to provide a reasonably thick flat plate having an outline preferably essentially the same as the outline of the two slatted receptacles supported upon the stand. See FIG. 10 where a circular solid base 34*a* is shown.

Figure 2:
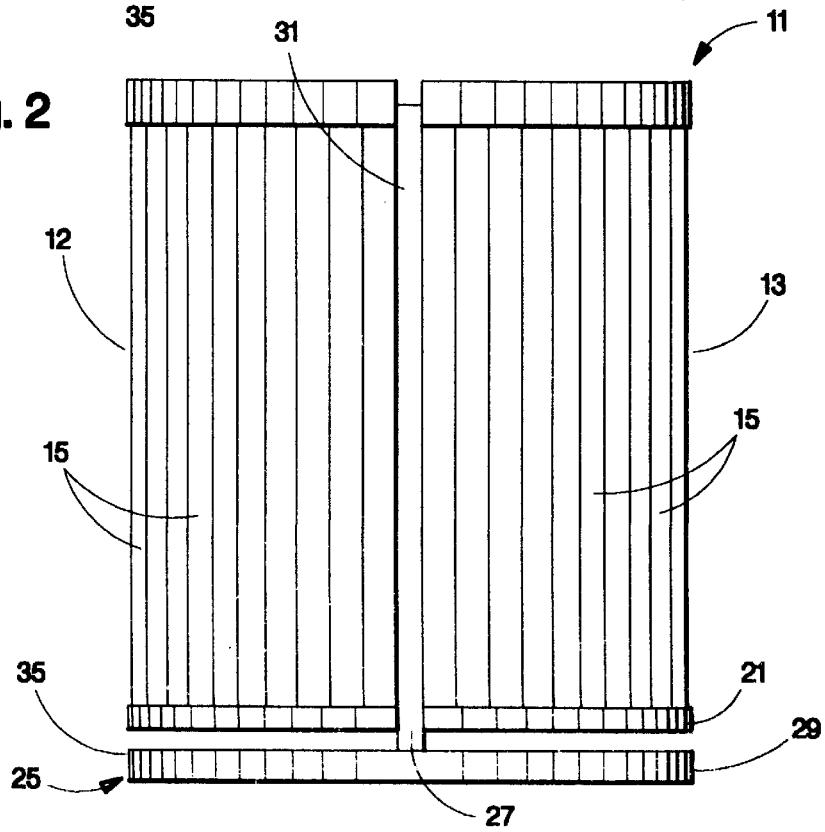
FIG. 2 is a side elevation of the assembly of the invention.
Figure 3:
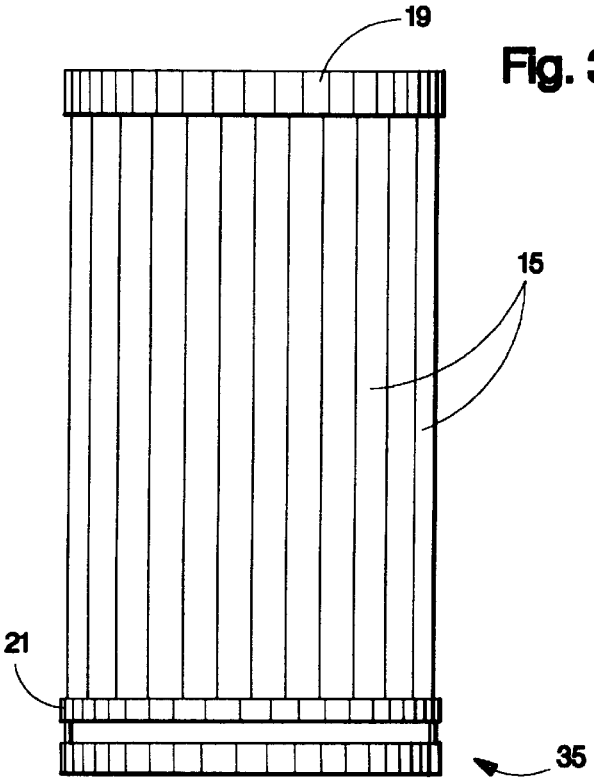
FIG. 3 is an end elevation of the assembly of the invention.
Figure 4:
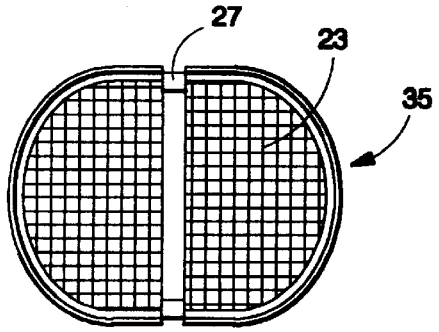
FIG. 4 is a bottom view of the assembly of the invention.
Figure 5:
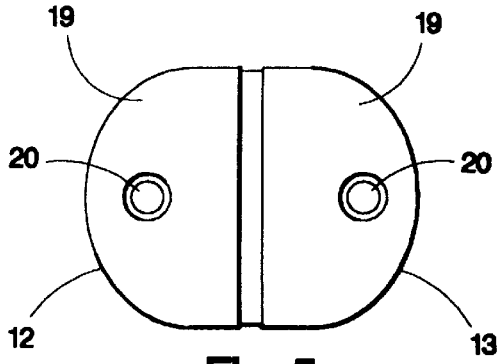
FIG. 5 is a top view of the assembly of the invention.
Figure 6:
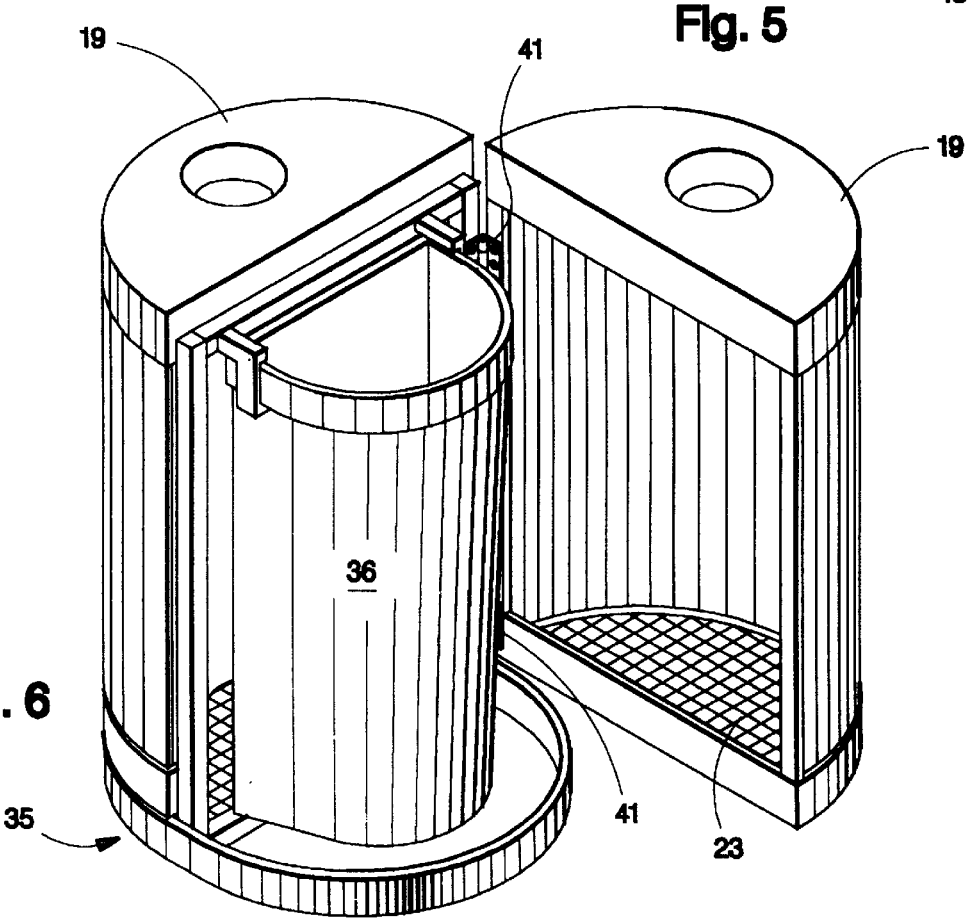
FIG. 6 is an isometric view of the assembly of the invention with one slatted receptacle swung away to show a light flexible plastic container or plastic trash bags within which refuse and recyclables are collected plus the inside of the slatted receptacle.
Figure 7:
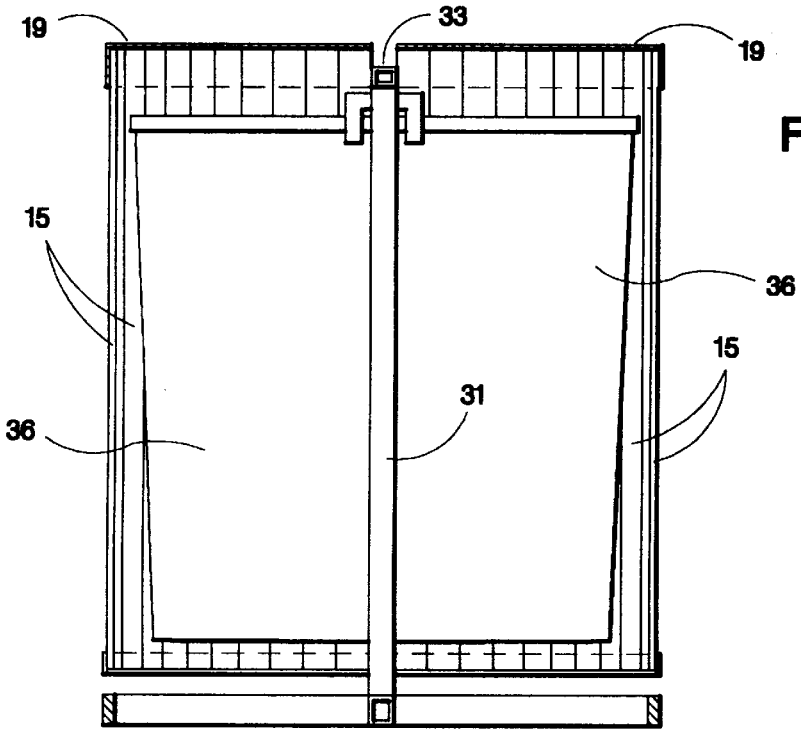
FIG. 7 is a side elevation view of the invention with both plastic slatted receptacles swung open showing a pair of rigid plastic containers supported from the frame for receipt of refuse and recyclables.

FIGS. 2, 4, and 5 illustrate how the upstanding support members 27 separates the two plastic slatted receptacles, providing a pleasing appearance as well. As shown in FIG. 6, when it is desired to remove light plastic or other containers 36 from the interior of the assembly, one or the other, or both, of the half-oval slatted receptacles, which are hinged by any suitable hinge arrangement 41, to one of the side sections 31 of the upstanding support member, are swung away on one side from the vertical member 31. The plastic container or containers 36 which are supported from the top cross-piece 33 of the upstanding support 27 can be easily unhooked and carried away. If desired such containers can be transferred on a wheeled transport that can be wheeled or inserted directly under such light containers particularly if a fairly flat base 34*a* is made use of such as shown in FIG. 10.

Figure 10:
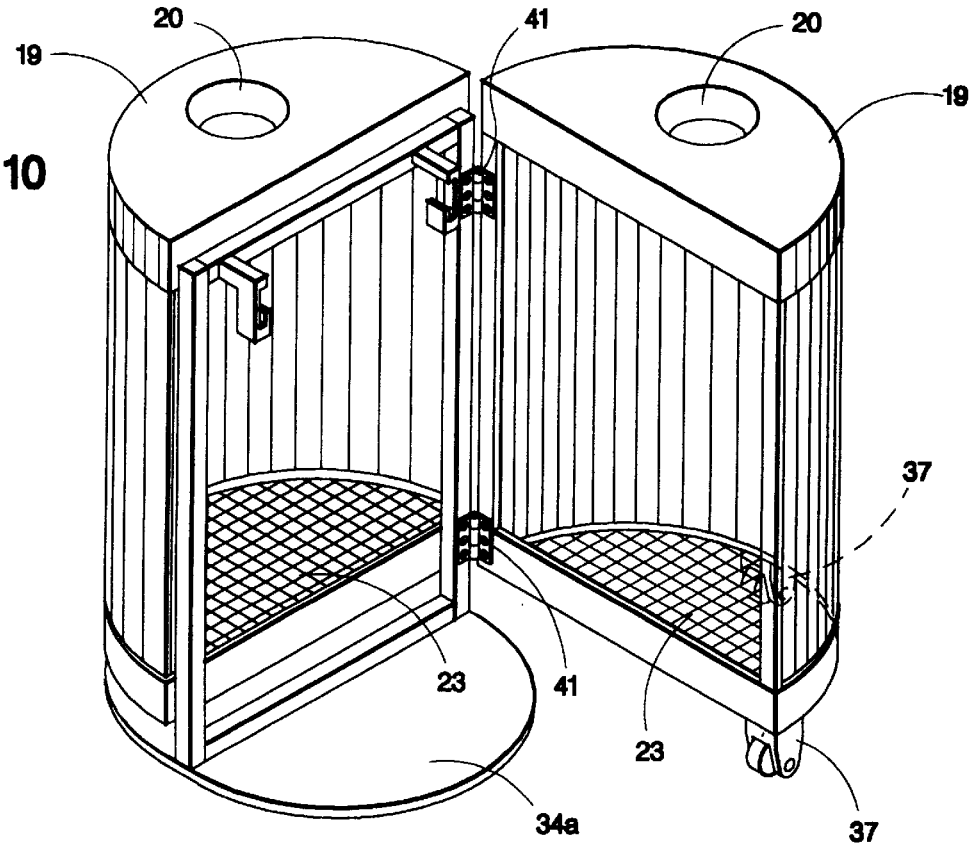
FIG. 10 is an isometric view of the assembly of the invention with one half-oval or round receptacle moved to the side on a caster at the bottom. An oval plate rather than a strip base is also shown.

As shown in FIG. 10 it is possible, although not preferred, to, rather than hinging the oval plastic upstanding support, to instead support such containers on/or by another means such as, for example mounting them on casters 37. They can then be rolled away from the central support 33 or crosspiece.

Figure 11:
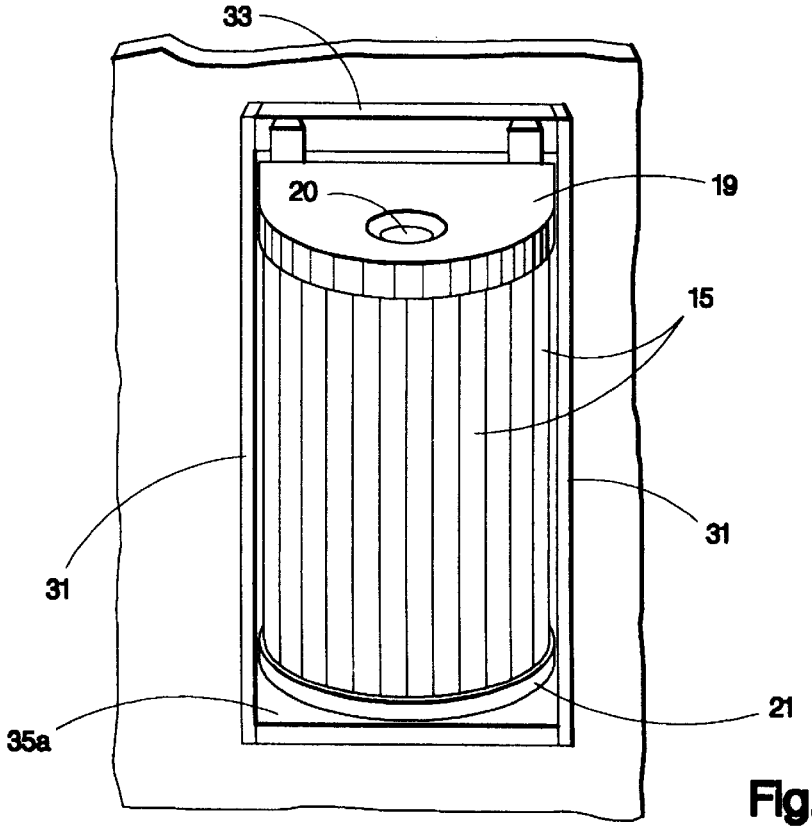
FIG. 11 is an isometric view of one of the assemblies of the invention with one half round receptacle removed and the entire assembly attached to a wall or other vertical surface.

FIG. 11 illustrates how if the curved base members are made so they can be removed from the central upstanding support member 27, one of such base members can be removed and half the assembly hung by suitable attachments upon a wall so as to take up even less wall space.

As will be recognized, forming a receptacle assembly in accordance with this invention provides an attractive receptacle assembly for recyclables and refuse that is also advantageous in preventing injury to trash collectors and other workmen who must empty the receptacles. The arrangement is sturdy and relatively inexpensive, yet eminently attractive and such as may be used in very upscale locations. The arrangement also allows larger capacity containers taking up less floor space which is frequently important in high volume business locations such as malls, downtown business locations and the like.

While the present invention has been described at some length and with some particularity with respect to the several described embodiments, it is not intended that it should be limited to any such particulars or embodiments or any particular embodiment, and is to be construed with reference to the appended claims so as to provide the broadest possible interpretation of such claims in view of the prior art and, therefore, to effectively encompass the intended scope of the invention

I claim:

1. A refuse and recycling receptacle assembly comprising:

(a) two plastic slatted receptacles each comprised of at least two half oval structural rings having a flat side from which extends a curved closed section forming a general half oval configuration, (b) plastic slats secured to the structural rings at least near the top and bottom of the slats to form a half oval plastic slat covered assembly having the flat side of such assembly open, (c) a top covering secured to the top structural ring of each half oval assembly to close off the upper portion of such assembly, said top having a restricted area orifice in its surface, (d) a bottom member secured to the lower portion of each half oval assembly to increase the integrity of the bottom and limit access from the bottom, (e) a support frame having an upstanding rectangular frame configuration with the side members of such rectangle being spaced from each other substantially the distance that the sides of the flat side of said assemblies are spaced from each other and the top cross-piece at substantially the distance from the support surface which is to support the assemblies and the tops of the slatted assemblies are to be positioned, (f) a stabilizing base upon which the rectangular frame is supported, and (g) the half oval structural rings being hingedly secured to one vertical member of the rectangular framework such that the slatted assemblies can be swung out from the rectangular support framework on one side.

2. A refuse and recycling receptacle assembly in accordance with claim 1 wherein the bottom member is provided with a plurality of restricted sized openings adapted to allow air circulation, but restrict entrance of pests.

3. A refuse and recycling receptacle assembly in accordance with claim 2 wherein the slatted assemblies are provided with locking means on the side opposite the hinge means to facilitate security of the contents of the assemblies from vandals and the like.

4. A refuse and recycling receptacle assembly in accordance with claim 2 wherein the stabilizing base for maintaining the upstanding rectangular frame configuration in an upright position is in a form of two components extending outwardly under the half oval slatted receptacles formed by the application of plastic slats to the half oval structural rings.

5. A refuse and recycling receptacle assembly in accordance with claim 4 wherein the base components extending outwardly under the half oval slatted receptacles formed by the plastic slats to the half oval structural rings are formed of half oval base members having a general configuration similar to that of the structural rings.

6. A refuse and recycling receptacle assembly in accordance with claim 5 wherein at least one of the base components extending outwardly under the slatted receptacles are removable to allow both such base and the half oval structure above to be removed from the assembly to allow the support frame to be attached to a wall whereby the assembly is in an upright position from such wall.

* * * * *